United States Patent [19]

Diekhoff

[11] Patent Number: 4,578,007

[45] Date of Patent: Mar. 25, 1986

[54] REFORMING NECKED-IN PORTIONS OF CAN BODIES

[75] Inventor: Hans H. Diekhoff, Greensburg, Pa.

[73] Assignee: Aluminum Company of America, Pittsburgh, Pa.

[21] Appl. No.: 588,355

[22] Filed: Mar. 12, 1984

Related U.S. Application Data

[63] Continuation-in-part of Ser. No. 428,492, Sep. 29, 1982, abandoned.

[51] Int. Cl.[4] ..... B21D 51/32

[52] U.S. Cl. ..... 413/6; 413/31; 72/68; 72/105; 72/370

[58] Field of Search ..... 72/68, 84, 94, 105, 72/121, 362, 370; 413/2, 6, 31, 73, 76

[56] References Cited

U.S. PATENT DOCUMENTS

| | | | |
|---|---|---|---|
| 2,337,452 | 12/1943 | Compo | 413/6 |
| 3,385,249 | 5/1968 | Czarnecki | 413/6 |
| 4,361,246 | 11/1982 | Nelson | 413/6 |
| 4,512,172 | 4/1985 | Abbott et al. | 72/68 |

FOREIGN PATENT DOCUMENTS

| | | | |
|---|---|---|---|
| 84136 | 7/1981 | Japan | 72/367 |
| 35027 | 3/1983 | Japan | 413/6 |
| 187449 | 10/1922 | United Kingdom | 413/6 |

*Primary Examiner*—Lowell A. Larson
*Attorney, Agent, or Firm*—Max L. Williamson

[57] ABSTRACT

A method for reforming at least a portion of a multiple necked-in can body to provide at least an essentially right cylindrical-shaped portion adjacent a last necked-in portion by contacting at least the portion adjacent above and below the last necked-in portion with a rotating roll and providing relative movement of the periphery of the can body with respect to the rotating roll.

6 Claims, 11 Drawing Figures

REFORMING NECKED-IN PORTIONS OF CAN BODIES

CROSS-REFERENCE TO RELATED APPLICATION

This is a continuation-in-part of U.S. Ser. No. 428,492, filed Sept. 29, 1982 now abandoned.

BACKGROUND

This invention relates to a method of making a multiple necked can body, and more particularly to a method of reforming at least a portion of a multiple necked-in portion to provide at least an essentially right cylindrical-shaped portion adjacent the last necked-in portion.

Methods of making two-piece cans by combining a drawn and ironed can body with a circular can end are well known. In these methods, the can user fills the can body and then typically attaches the can end to the can body by a method known in the trade as double seaming. With the ever-increasing use of such cans, particularly for packaging beverages, there has been an intensive effort made by the manufacturer to reduce the weight or amount of material in the can.

One such effort has been in the direction of reducing the amount of metal in the can end by reducing the diameter of the open end of the can body which results in using less metal in the can end. The process of reducing the diameter of an open end of a tubular body is known as necking and is accomplished generally by one of two methods. In a spin-form method, the tubular body, such as a can body, for example, is placed upon a rotating mandrel and as the can body rotates, a tool is impinged against the periphery of portion of the body to be necked in. The tool is advanced inwardly toward the axis of the can body along an arc of predetermined radius until the desired reduction in diameter is achieved. In a push-form method, the closed end of the can body is mounted in a fixture in axial alignment with a female forming die. By axial movement of either the fixture or the forming die, the can body is moved into the forming die which is configured to neck a portion of the open end of the can body by forming the metal along an arc of predetermined radius until the desired diameter is reached.

In either method there are limits as to the amount of diameter reduction that can be made in a single necking operation because the inward forming puts the metal in compression. Since the metal being formed in a can body is relatively thin, only a slight reduction in diameter can be made without causing the metal to wrinkle along the formed surface.

It has been discovered, however, that by making separate, sequential necking steps, a far greater reduction in diameter can be made without wrinkling than if the necking were done in a single step. This discovery has led to methods known as multiple necking and further categorized by the number of necking steps employed, double necking and triple necking, for example. Multiple necking produces a portion, extending upwardly from a lower cylindrical portion of the can body, comprised of segments having progressively smaller diameters stacked one on another. The axial extent of such portion is commonly referred to as the stack height. An essentially right cylindrical portion extending upwardly from such segmented portion to the flange of the can body is commonly referred to as the neck.

Although multiple necking is advantageous to achieve a maximal reduction in diameter and thus lessen the amount of metal required to make a can end, some disadvantages are introduced as well. For example, in a can of a given length, having a portion of the can of reduced diameter obviously decreases the volume available for the can contents. It is desirable, therefore, to keep the total extent or axial length of the necked-in portion, including the neck, to a minimum. This means that in each separately necked-in portion the smallest forming radius possible that can be used without wrinkling the metal should be employed, and the necked-in portion of the can should be confined to the smallest possible portion of can length adjacent the can end to be closed by double seaming. In the view of at least some packagers of carbonated beverages, however, the slightly rippled appearance resulting from necking to produce a multiple necked can detracts from the aesthetics of the package. Furthermore, some packagers of carbonated beverages believe that maximizing the neck length of a multi-necked can is advantageous in applying a commonly used multi-pack plastic carrier adjacent the ends of the cans.

Heretofore, in providing a multiple necked can, it has been considered desirable to minimize the extent of the neck immediately adJacent the can bead because it was believed that the overall length of the necked-in portion would necessarily have to be increased for each added increment of neck. It may be seen that increasing the overall length by adding to the neck, without altering the configuration of the necked-in portions below the neck, would either necessitate an overall increase in the length of the can or lower the position on the can at which the multiple neck forming operation is begun. Neither of these alternatives is considered to be desirable in a multiple necked can.

It would be desirable, therefore, to provide a method for making a multi-necked can body having a longer neck adjacent the annular bead of the double-seamed end without increasing the overall length of the necked-in portion of the can body.

SUMMARY OF THE INVENTION

In this invention a can body is multiple necked and at least a portion of the multiple necked-in portion is reformed thereafter. Such reforming may be accomplished before flanging of the open end of the can body, after flanging, during double seaming of a can end to the open end of the can body, or after double seaming.

In the practice of a method of this invention, a multiple necked-in can body is supported axially and restrained from axial or lateral movement. A rotating roll adapted for lateral movement with respect to the can body contacts at least a portion of the can body adjacent above and below the last necked-in portion of the can body and relative movement of the periphery of the contacted portion with respect to the roll is provided. The rotating roll is adapted to at least reform the portion of the can body adjacent above and below the last necked-in portion into an essentially right cylindrical-shaped portion. Thus, an essentially right cylindrical-shaped neck portion is provided adjacent the bead on a double-seamed can without increasing the length of the stack height.

The terms "essentially right cylindrical shape" and "essentially right cylinder" as used in reference to reforming a can body by a method of this invention are intended to mean the shape of the reformed portion after the reforming method is completed. It is well known that some materials exhibit spring-back characteristics. That is, after being formed into a particular shape and the forming force is removed, the material tends to return to its original shape which alters to some degree its formed shape. During the course of reforming a portion of a can body by a method of this invention, at least some part of the reformed portion may spring back, and thus the terms "essentially right cylindrical shape" and "essentially right cylinder" are intended to include the shape of the reformed portion after spring-back, if any, has occurred.

In a further aspect of the invention, a portion of the can below and adjacent the second necked-in portion is reformed into a frustoconical portion having a substantially uniform inwardly curving wall section.

As has been previously noted in forming a thin wall metal can body by necking, the amount of forming is limited by the susceptibility of the metal to wrinkling. It is apparent that thin metal sections are extremely sensitive to the amount of cold work that may be absorbed without wrinkling, cracking, fracture or otherwise generating a flaw in the formed metal. Since reforming a previously formed portion adjacent a necked-in portion inherently involves adding cold work in the reformed portion, reforming of such a portion has heretofore been avoided to prevent the likelihood of damage from the added cold work. It has been surprisingly discovered, however, that a previously formed portion of a thin wall metal can body can be reformed into an essentially right cylinder shape by a process of this invention.

It is an object of this invention to provide a method for making a multi-necked double-seamed can having a neck adjacent the double-seamed bead of the can of a suitable length for applying a multi-pack carrier.

It is also an object of this invention to provide a method of making a multi-necked can body closed with a can end by double seaming which assures that an essentially right cylinder neck portion is provided adjacent the can bead without increasing the overall height of the can.

It is a further object of this invention to improve the aesthetics of a multi-necked can.

These and other objects and advantages of the invention will be more apparent with reference to the following description of a preferred embodiment of the invention and the appended drawings.

DESCRIPTION OF A PREFERRED EMBODIMENT

Figure 1:
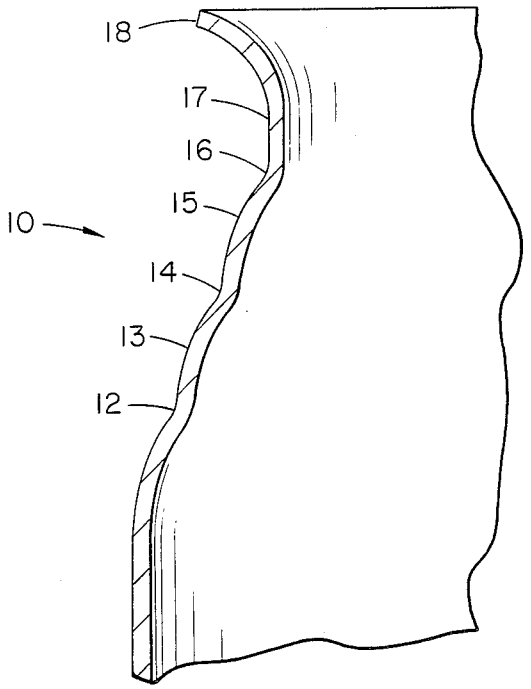
FIG. 1 is a partial section of a typical prior art flanged multi-necked can body.

In the practice of a method of this invention, a multiple necked can body having the typical flanged and necked-in configuration shown in FIG. 1 is provided. The can body 10 includes first 12, second 14 and third 16 necked-in portions or annular steps, an essentially cylindrical neck 17, and a flanged portion 18 which may be produced by either a push-form or spin-form process, both processes being known to those skilled in the art. Intermediate the necked-in portions 14, 16 is an outwardly projecting curved portion 15, and intermediate necked-in portions 12, 14 is an outwardly projecting curved portion 13. The dimensions relative to the necked-in portions 12, 14, 16, the outwardly projecting curved portions 13, 15, the neck 17, and the flanged portion 18 will vary depending on the size of the can body, the wall thickness of the metal in the forming areas and the particular metal being formed, but generally the dimensions will be such as to assemble a can by double seaming as shown in partial cross section in FIG. 2. A bead 22 around the periphery of the open end of the can body 10 is formed of layers of metal of the can body 10 and circular end 20 by a process known as double seaming. It may be seen that most, if not all, of the neck 17 is incorporated into the can bead 22, and the can body portion 24 immediately adjacent the bead 22 is of a frustoconical shape and is a transition section between the third or last necked-in portion 16 and the neck portion 17 incorporated into the bead 22. A can of this embodiment is generally referred to as a short neck can since it embodies a minimal axial length of a formed neck portion 17 and little, if any, if the neck is below the can bead after double seaming.

Figure 2:
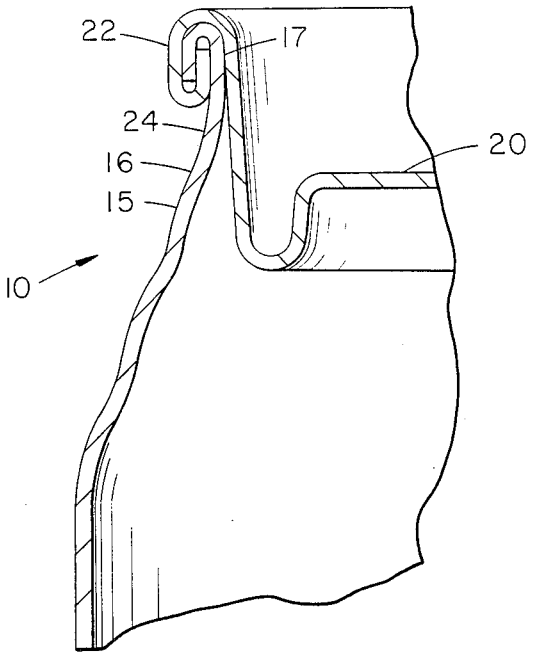
FIG. 2 is a partial section of a typical prior art double-seamed multi-necked can.
Figure 3:
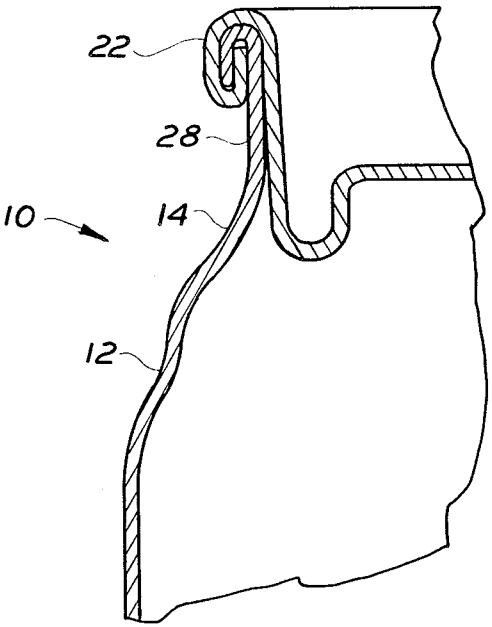
FIG. 3 is a partial section of a double-seamed multi-necked can reformed in accordance with the invention.

The difference between a can assembled with a can body reformed by a method of this invention and a can assembled with an unreformed can body may be seen by comparing FIG. 3 with FIG. 2. In FIG. 3, the transition portion 24 adjacent and above the last necked-in portion 16, the last necked-in portion 16 and the outwardly projecting curved portion 15 adjacent and below the last necked-in portion shown in FIG. 2 have been reformed, as will be explained later, to produce an essentially right cylinder portion 28 adjacent the can bead 22 which substantially lengthens neck 17 without increasing the overall axial length of the necked-in portion.

Reforming of a previously formed portion of a can body of this invention will now be explained with reference to FIGS. 4, 5 and 6.

Figure 4:
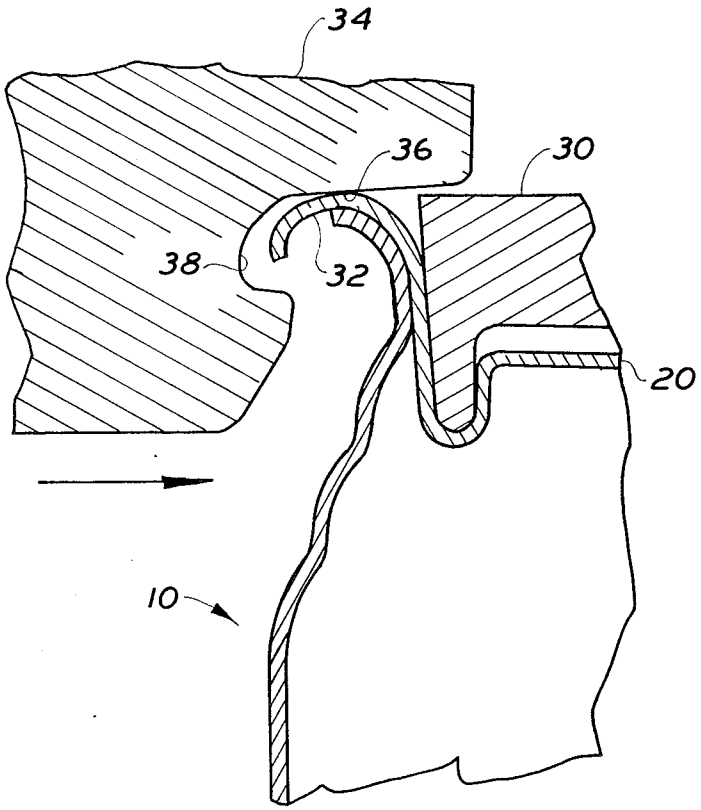
FIG. 4 is a partial section of a first seaming roll for practicing this invention making initial contact with a flanged portion of a can end to partially fold and form the can end and can body flanges.

Referring first to FIG. 4, a can body 10 is mounted on a support (not shown) that is adapted to rotate the can body about its longitudinal axis. A plug or seaming chuck 30, coaxially aligned with the can body and also adapted to provide the rotational drive force to rotate the can body about its axis, forcibly engages the can end 20 with the can body 10 and prevents axial and lateral movement of the can body. The can end 20, prior to double seaming, has an outwardly projecting annular flange 32 having sufficient extent to form a double-seamed bead 22 as shown in FIG. 3.

A first seaming roll 34 is mounted adjacent the can body 10 and is adapted for rotation about a central axis parallel to the longitudinal axis of the can body, and the seaming roll is also adapted for lateral movement toward the can body as indicated by the directional arrow. To initiate forming the bead 22 (shown in FIG. 3), the seaming chuck 30 rotates the can body 10 about its axis as the seaming roll is advanced toward the can body. As a result, an annular, planar surface 36 of seaming roll 34 contacts the upper surface of the can end flange 32 and causes the seaming roll 34 to rotate in the opposite direction, and with continued advancement of the seaming roll, the flange is directed into the curved, annular forming recess 38 of the seaming roll 34.

Figure 5:
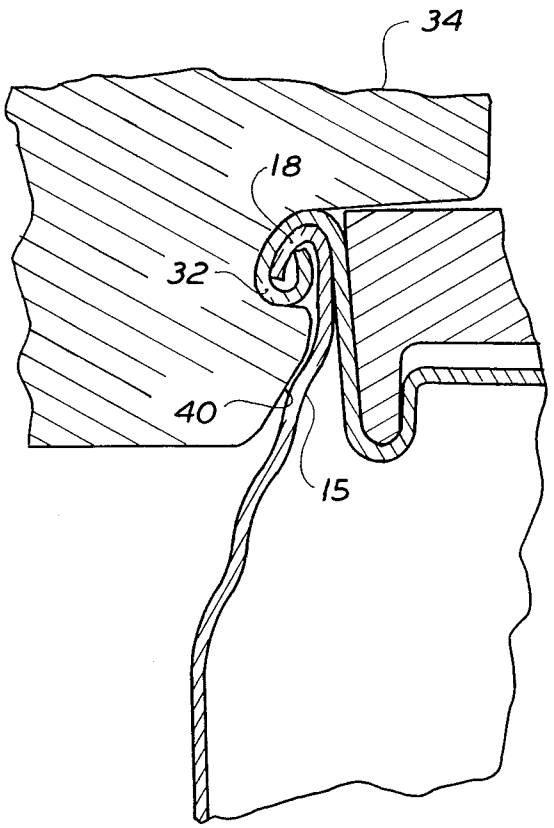
FIG. 5 is a partial section of the seaming roll shown in FIG. 4 at the completion of partially folding and forming the can end and can body flanges.

Referring now to FIG. 5, the first seaming roll 34 is shown at the point of its furthest advance toward the can body. An annular surface 40, tapering inwardly toward the roll axis, is provided on seaming roll 34 to avoid contacting the outwardly projecting portion 15 during this initial seaming step. As may be seen, the forming recess 38 acts upon the can end flange 32 and can body flange 18 to fold and form the flanges preparatory to completing the final forming of the bead 22 (shown in FIG. 3).

Figure 6:
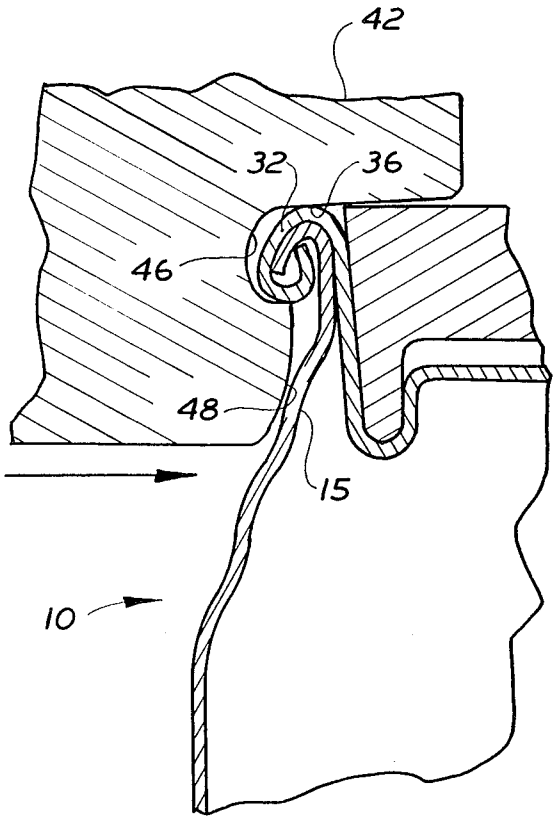
FIG. 6 is a partial section of a final seaming roll adapted to reform a portion of a can body adjacent the can bead in accordance with this invention with the seaming roll making initial contact with the partially formed and folded flange of the can end.

After partial forming of the double seam as shown in FIG. 5, the first seaming roll 34 is retracted and a final seaming roll 42 is positioned adjacent the can body 10 as shown in FIG. 6. The final seaming roll 42 is adapted to rotate about its central axis which is parallel to the longitudinal axis of the can body 10, and the final seaming roll is also adapted to move laterally toward the can body as indicated by the directional arrow. In originating the final step in double seaming and reforming of a previously necked-in portion of the can body 10, the seaming chuck 30 again rotates the can body 10 about its axis as the seaming roll 42 is advanced toward the can body. An annular, planar surface 36 contacts an upper surface of the partially deformed can end flange 32 and causes the seaming roll 42 to rotate in the opposite direction, and the partially deformed can end flange 32 is directed into a curved annular forming recess 46 which is contoured to provide the finished form of the annular bead 22 (shown in FIG. 3). Projecting downward from the forming recess 46, an essentially right cylindrical reforming surface 48 is provided to bear against the outwardly projecting portion 15 and reform such surface into an essentially right cylindrical surface as the seaming roll 42 advances toward the can body axis.

Figure 7:
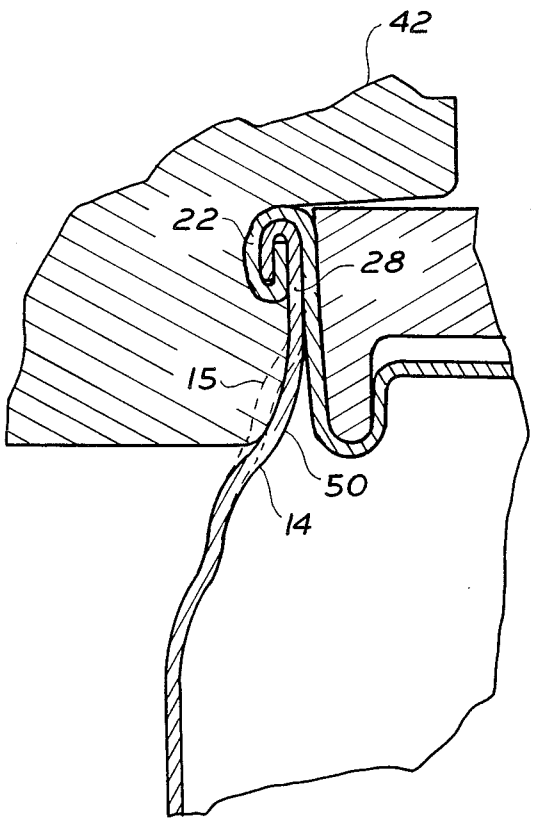
FIG. 7 is a partial section of the final seaming roll shown in FIG. 6 with the seaming roll at the completion of its movement to form a can bead and reform a portion of the can body adjacent the can bead in accordance with this invention.

Referring now to FIG. 7, the final seaming roll 42 is shown at its point of furthest advance in forming the double-seamed annular bead 22 while reforming the outwardly projecting portion 15 (shown as dotted lines) into an essentially right cylinder portion 28 and an outwardly flaring transition portion 50 connecting with the second necked-in portion 14.

Figure 8:
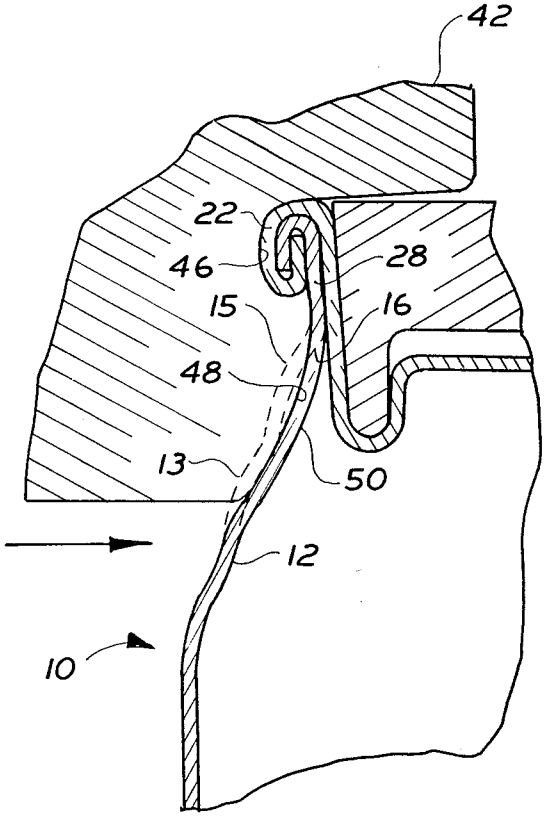
FIG. 8 is a partial section of a final seaming roll adapted to reform a portion of a can body intermediate a first necked-in portion and a second necked-in portion as well as a portion adjacent the can bead with the seaming roll at the completion of its movement to form the can bead and reform such portions in accordance with this invention.

By a method of this invention, a second portion of a multiple necked can body may be reformed as well as the portion adjacent the can bead, as may be seen with reference to FIG. 8. In FIG. 8, the final seaming roll 42 is shown at the completion of its lateral advance toward the can body 10. The can bead 22 has been formed by the seaming roll 42 in the same manner as has been previously described in reforming the portion adjacent the bead 22 while double seaming a can end. It may be seen in FIG. 8 that the reforming surface 48 of the final seaming roll 42 extends downwardly from the annular bead forming recess 46 a sufficient distance to bear against both the outwardly projecting portion 15 and the outwardly projecting portion 13 (shown in dotted lines) as the roll 42 advanced laterally in a direction toward the can body. From the force of the reforming surface 48 against the outwardly projecting portions 15, 13, and connecting necked-in portion 14 therebetween, the can body 10 has been reformed to provide an essentially right cylindrical-shaped portion 28 adjacent the bead 22 and a transition portion 50 flaring outwardly from the right cylindrical portion 28 to the first necked-in portion 12.

Figure 9:
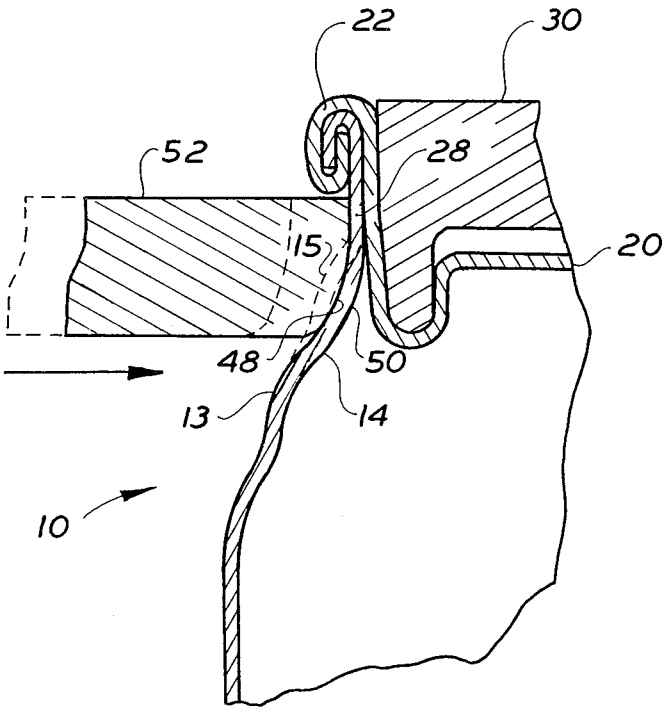
FIG. 9 is a partial section of a reforming roll adapted to reform a portion of a can body adjacent the bead of a closed end can after the can has been double seamed with the reforming roll shown at the completion of its movement to reform such portion in accordance with this invention.

An essentially right cylindrical-shaped portion adjacent the bead of a closed can may also be provided by a process of this invention after the can has been closed by double seaming. Referring to FIG. 9, a can body 10 is shown with a can end 20 double seamed to the can body to form a bead 22 in a manner that has previously been described. The can body 10 is mounted on a support (not shown) that is adapted to rotate the can body about its longitudinal axis. A seaming chuck 30 coaxially aligned with the can body and also adapted to rotate the can body about its axis is impinged against the can end 20 with sufficient downward thrust to prevent any axial or lateral movement of the can body. It may be seen that the support system and seaming chuck 30 may be those that were employed in double seaming the can end to the can body.

In this embodiment of producing an essentially right cylindrical-shaped portion of the can body adjacent the bead, a reforming roll 52 having an annular reforming surface 48 is provided and the roll is adapted to rotate about its axis which is parallel to the can body axis and it is also adapted for lateral movement toward the can body as shown by the directional arrow. In FIG. 9, the roll 52 is shown at the point of its furthest lateral advancement at the completion of its reforming action.

Preparatory to reforming a portion of the can body by a process of this invention, the reforming roll 52 is positioned adjacent the can body 10 but spaced apart therefrom so that it is not in contact with the can body as shown in dashed lines. With the can body 10 rotating about its longitudinal axis, the reforming roll 52 is advanced laterally toward the can body in a direction indicated by the arrow. It is to be noted that as roll 52 advances laterally, contact with the can bead 22 is avoided. With advancement of roll 52, the reforming surface 48 contacts the outwardly projecting portion 15 of the can body causing the reforming roll to rotate in the opposite direction, and portion 15 is reformed into essentially right cylindrical portion 28 adjacent the can bead 22 and a portion 50 flaring outwardly from the essentially right cylindrical portion 28 to necked-in portion 14. It is evident that reforming roll 52 could be adapted to extend the reforming surface 48 a distance sufficient to bear against outward projection 13 and reform an additional necked-in portion of the can body, as has been previously described.

Figure 10:
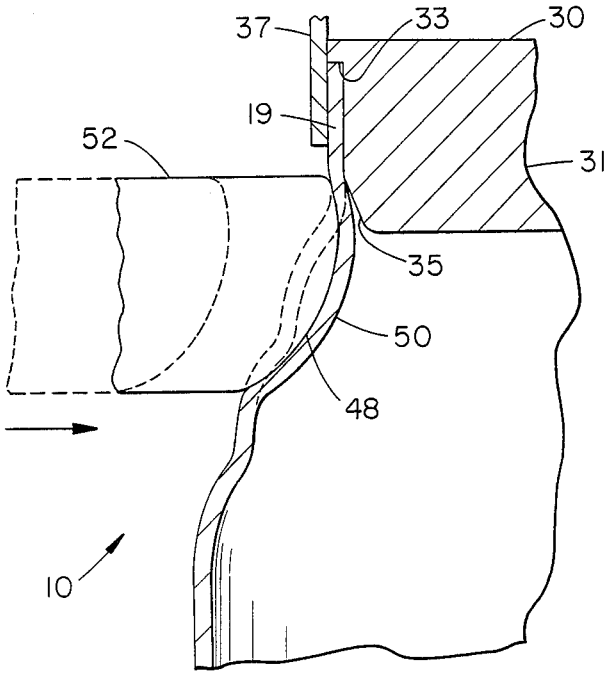
FIG. 10 is a partial section of a reforming roll adapted to reform a multi-necked portion of a can body before flanging with the roll shown at the completion of its movement to reform such portion in accordance with this invention.

A method of this invention also includes reforming necked-in portions of a multiple necked-in can body before or after flanging the open end of the can body. Referring now to FIG. 10, a can body 10 having first, second, third or last necked-in portions, as has previously been described, and a substantially cylindrical open-end portion 19 extending upward from the last necked-in portion 16 is supported on a platform (not shown). A plug 30 has a portion 31 adapted to fit within the cylindrical open end 19 of the can body and an outwardly extending ledge 33 bearing upon the top edge of the can end to restrain the can body from axial movement. A cylindrical sleeve 37 adapted for axial movement independent of the plug 30 is provided to prevent lateral movement of the open-end portion 19. A reforming roll 52 having an annular reforming surface 48 is adapted to rotate about its axis and is also adapted for lateral movement with respect to the can body, as shown by the directional arrow. The plug 30 and support platform are adapted to rotate with one or the other, or both, providing drive to rotate the can body 10 about its longitudinal axis. In FIG. 10, the roll 52 is shown at the point of its furthest lateral advancement at the completion of its reforming action. The position of the reforming roll 52 prior to contacting the can body 10 is adjacent to the can body but spaced away therefrom as shown by the dashed lines.

Reforming of at least a portion of the multi-necked portion is accomplished in the same manner as has previously been described. In the embodiment shown in FIG. 10, the multiple necked portion shown in dashed lines is reformed into a generally arcuate portion 50. It may be noted that FIG. 10 also shows how an allowance for spring-back may be made. The plug 30 is provided with a tapered surface 35 which allows the reforming roll 52 to be advanced laterally a greater distance inwardly into the can body than necessary to achieve the desired reformed contour. When the reforming roll is removed from contact with the can body, the reformed portion 50 springs back to assume the desired contour.

Figure 11:
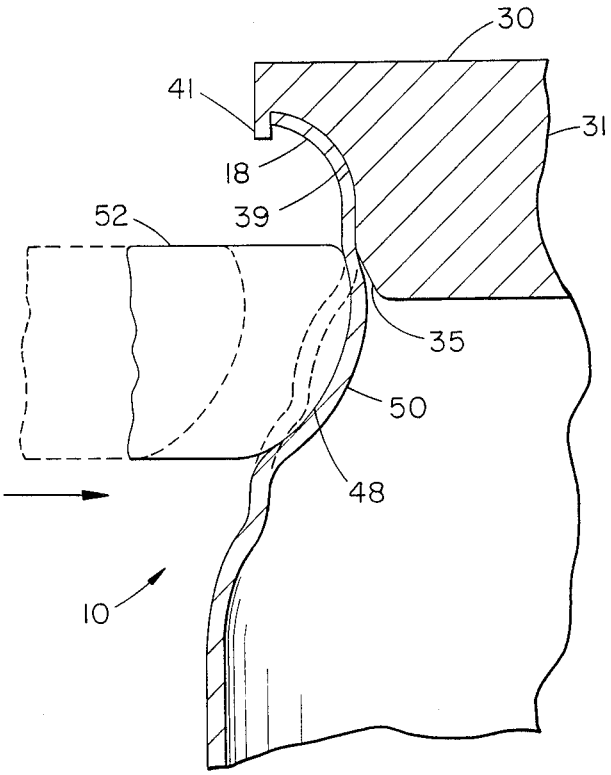
FIG. 11 is a partial section of a reforming roll adapted to reform a multi-necked portion of a can body after flanging with the roll shown at the completion of its movement to reform such portion in accordance with this invention.

Reforming a multi-necked portion of a flanged can body is as shown in FIG. 11 and is the same in all respects as the description for reforming a multi-necked can body before flanging except plug 30 is adapted to accommodate the can body flange 18. Plug 30 in FIG. 11 includes a lower portion 31 adapted to fit within the can body open end. An upper portion of the plug includes a generally curved surface portion 39 adapted to substantially conform to the outwardly projecting flange 18 and an annular flange 41 extending downwardly at the outermost extent of the curved surface 39. The can body 10 is thus restrained by the plug 30 from axial or lateral movement.

In the foregoing descriptions of modes of practice of this invention, the can body 10 is rotated about its longitudinal axis to provide peripheral movement of the multi-necked portion relative to the reforming roll. It is evident that movement of the roll around the multi-necked portion of the can body could also be accomplished by holding the can body stationary and revolving the reforming roll around the can body.

While the invention has been described in terms of preferred embodiments, the claims appended hereto are intended to encompass all embodiments which fall within the spirit of the invention.

What is claimed is:

1. A method of providing an essentially right cylindrical-shaped portion of a multiple necked-in and flanged can body adjacent a double-seamed bead of a closed can, the method comprising:

rotating said can body about its longitudinal axis; and contacting said rotating can body with means for reforming at least a portion of the necked-in can body to produce an essentially right cylindrical-shaped reformed portion adjacent the double-seamed bead of the closed can.

2. The method as described in claim 1 wherein said reforming means is a final seaming roll adapted to provide said reforming while forming the double-seamed bead on the can.

3. The method as described in claim 1 wherein said reforming means is a reforming roll adapted to reform said portion of the necked-in can body after a can end has been applied to the can body by double seaming.

4. The method as described in claim 1 wherein said can body is a triple necked-in can body and said reformed portion of the necked-in can body comprises a last necked-in portion adjacent the double-seamed bead of the closed can and an outwardly projecting portion connecting the last necked-in portion and a second necked-in portion.

5. The method as described in claim 4 in which the reformed portion further includes an outwardly projecting portion between the second necked-in portion and a first necked-in portion.

6. A method of providing an essentially right cylindrical-shaped reformed portion of a multiple necked-in can body adjacent a double-seamed bead of a closed can, the method comprising:

engaging a flanged can end within a flanged opening of an open end of the can body;

rotating said can body having the can end engaged therewith about the can body's longitudinal axis;

contacting the flange of the can end with a firs;t seaming roll adapted for rotation about an axis parallel to the axis of the can body, adapted for lateral movement perpendicular to the can body axis and further adapted to partially fold and form the flange of the can end and the flange of the can body as the first seaming roll is rotated about its axis in a direction counter to the direction of rotation of the can body and as the first seaming roll is advanced laterally toward the can body until the flanges of the can end and can body are partially formed and folded; and contacting the partially formed and folded flange of the can end with a final seaming roll adapted for rotation about an axis parallel to the can body axis, adapted for lateral movement perpendicular to the can body axis and further adapted to fold and form the partially formed and folded flange of the can end and flange of the can body into a double-seamed can end and to reform at least a portion of the necked-in portion of the can body into a essentially right cylindrical shape adjacent the can bead as the final seaming roll is rotated about its axis in a direction counter to the direction of rotation of the can body and as the final seaming roll is advanced laterally toward the can body until the can bead is formed and the essentially right cylinder portion of the can body adjacent the can bead is reformed from at least a portion of the multiple necked-in portion of the can body.

* * * * *